US005449271A

United States Patent [19]

Bushnell et al.

[11] Patent Number: 5,449,271

[45] Date of Patent: Sep. 12, 1995

[54] TRANSVERSE FAN WITH RANDOMLY VARYING I-SHAPED TONGUE

[75] Inventors: Peter R. Bushnell, Cazenovia; Rudy S. T. Chou, Liverpool, both of N.Y.

[73] Assignee: Carrier Corporation, Syracuse, N.Y.

[21] Appl. No.: 363,783

[22] Filed: Dec. 27, 1994

[51] Int. Cl.[6] ..... F04D 5/00; F04D 29/66

[52] U.S. Cl. ..... 415/119; 415/53.2; 415/53.1

[58] Field of Search ..... 415/53.1, 53.2, 119

[56] References Cited

U.S. PATENT DOCUMENTS 5,094,586 3/1992 Takada et al. ..... 415/53.3
5,197,850 3/1993 Shinobu et al. ..... 415/53.1

FOREIGN PATENT DOCUMENTS 62-118095 5/1987 Japan ..... 415/119
1-167494 7/1989 Japan ..... 415/53.1
3-229992 10/1991 Japan ..... 415/53.1
3-249396 11/1991 Japan ..... 415/53.1

*Primary Examiner*—F. Daniel Lopez
*Assistant Examiner*—Michael S. Lee

[57] ABSTRACT

A vortex wall (14) and impeller (30) assembly for a transverse or cross flow fan (10). The wall is intended to reduce blade rate tonal noise and is formed in a number of segments (15). The segments have noses with J shaped cross sections and are arranged so that the J tail (16) of one segment points in the opposite direction from the J tail of an adjacent segment. The spanwise widths (W), segment-to-impeller clearances (c) and setting angles ($\theta$) vary randomly, within specified limits, among the segments.

4 Claims, 3 Drawing Sheets

TRANSVERSE FAN WITH RANDOMLY VARYING I-SHAPED TONGUE

BACKGROUND OF THE INVENTION

This invention relates generally to the field of air moving apparatus such as fans and blowers. More specifically, the invention relates to a fan of the transverse type. Transverse fans are also known as cross-flow or tangential fans.

The operating characteristics and physical configuration of transverse fans make them particularly suitable for use in a variety of air moving applications. Their use is widespread in air conditioning and ventilation apparatus. Because such apparatus almost always operates in or near occupied areas, a significant design and manufacturing objective is quiet operation.

FIG. 1 shows schematically the general arrangement and air flow path in a typical transverse fan installation. FIG. 2 shows schematically the main features of a typical transverse fan installation. FIG. 3 shows the main features of a typical transverse fan impeller. Fan assembly 10 comprises enclosure 11 in which is located impeller 30. Impeller 30 is generally cylindrical and has a plurality of blades 32 disposed axially along its outer surface. Impeller 30 comprises several modules 32, each defined by an adjacent pair of partition disks 34 or by one end disk 33 and one partition disk 34. Between each adjacent pair of disks longitudinally extend a plurality of blades 31. Each blade is attached at one of its longitudinal ends to one disk and at the other end to the other disk of the pair. A given impeller may comprise multiple modules as depicted in FIG. 3 or but a single module, where the blades attach at either end to an end disk. The choice of a single or multiple module configuration depends upon such factors as fan size, construction material strength and weight and the like. As impeller 30 rotates, it causes air to flow into enclosure 11 into inlet plenum 21, through impeller 30 and out of enclosure 11 through outlet plenum 22. Rear or guide wall 16 and vortex wall 14 each form parts of both inlet and outlet plena 21 and 22. Vortex wall 14 has nose 15 which is that portion of wall 14 closest to impeller 30. The general principles of operation of a transverse fan need not be further elaborated upon except as necessary to an understanding of the present invention.

When a transverse fan is operating, it generates a certain amount of noise. One significant component of the total noise output of the fan is a tone having a frequency related to the rotational speed of the fan multiplied by the number of fan blades (the blade rate tone). The passage of the blades past the vortex wall produces this blade rate tone. Tonal noise is in general more irritating to a listener than broad band noise of the same intensity. The blade rate tone produced by the typical prior art transverse fan has limited the use of such fans in applications where quiet operation is required.

Manufacturing a transverse fan having randomly or nonuniformly spaced parts to reduce blade tonal noise is known in the art, see e.g. U.S. Pat. No. 4,538,963 (issued 3 Sep. 1985 to Sugio et al.) and U.S. Pat. No. 5,266,007 (issued 30 Nov. 1993, one of the inventors of which is also an inventor of the present invention and which is assigned to the same assignee as the present invention.

It is the interaction between air flow associated with the fan blades and the vortex wall that produces the blade rate tone in a transverse fan. Therefore one can reduce the blade rate tone by any means that reduces the regularity of the interaction between the blades and the vortex wall.

SUMMARY OF THE INVENTION

The present invention is a vortex wall and impeller assembly for a transverse fan installation. The passage of the blades of the fan impeller past the vortex wall cause pressure pulses that are a source of tonal noise. The wall and impeller of the present invention causes irregularity in the amplitude and phase of the pressure pulses and thus can reduce the blade rate tonal noise.

The vortex wall is divided into spanwise segments. Each segment has a nose that is J-shaped in cross section. The segments are configured so the tails of the Js in adjacent segments extend in opposite directions. The segments are arranged so that wall-to-impeller clearances vary randomly, within limits, among the segments. The setting angles of the segments also vary randomly within limits.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENT

The general information presented in the Background section above on the configuration and operation of a transverse fan apply to a fan having a vortex wall configured according to the teaching of the present invention.

Figure 1:
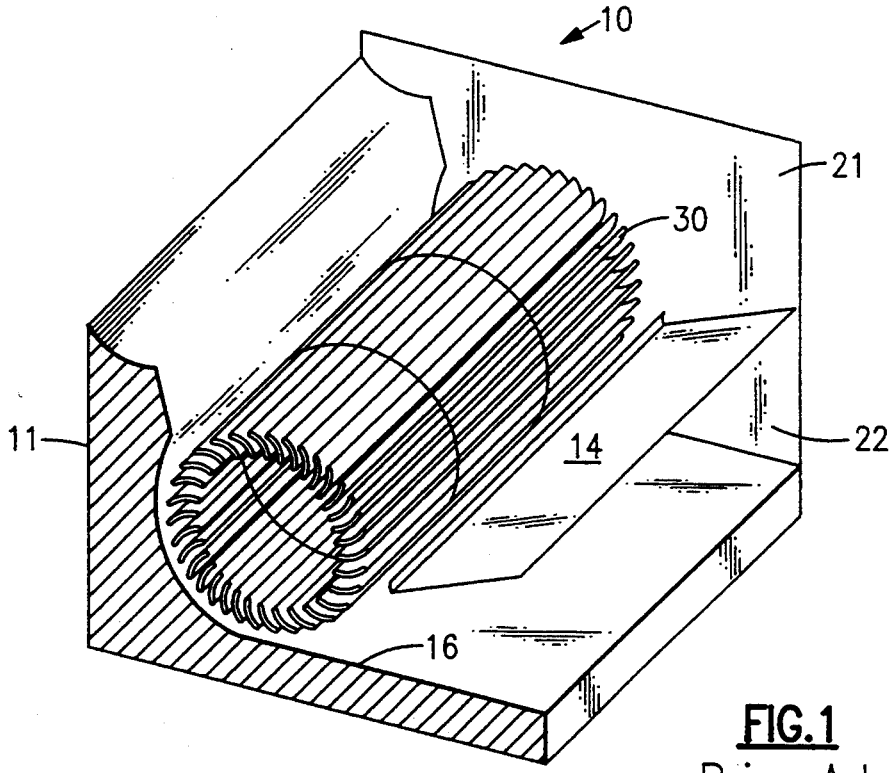
FIG.1 Prior Art
FIG. 1 is a general view, partially broken away, of a typical transverse fan installation.
Figure 2:
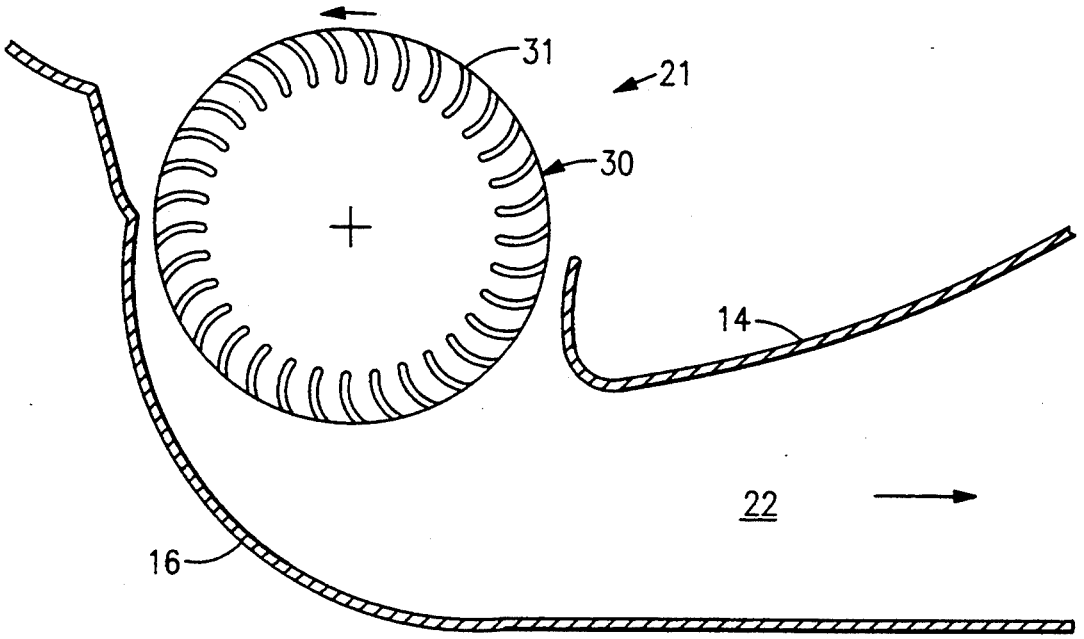
FIG.2 Prior Art
FIG. 2 is a schematic diagram of the principal parts of and air flow path through a typical transverse fan.
Figure 3:
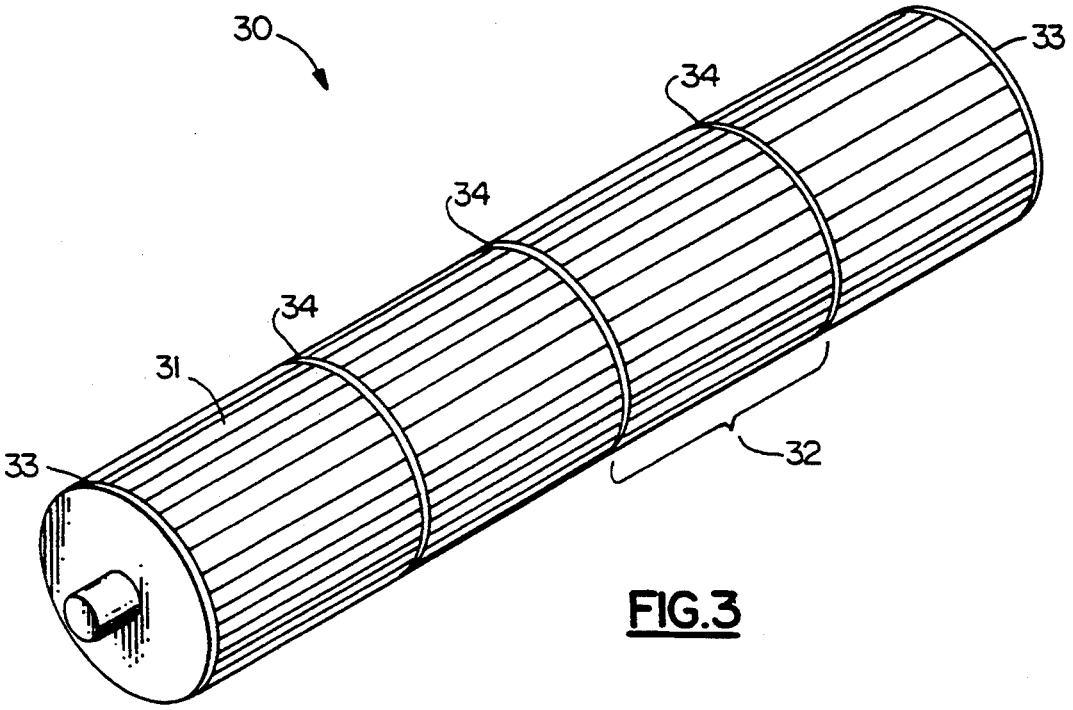
FIG. 3 is a pictorial view of a typical transverse fan impeller.
Figure 5:
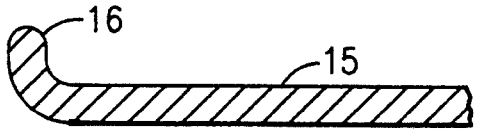
FIG. 5 is a cross sectioned view of the nose of the vortex wall of the present invention.
Figure 4:
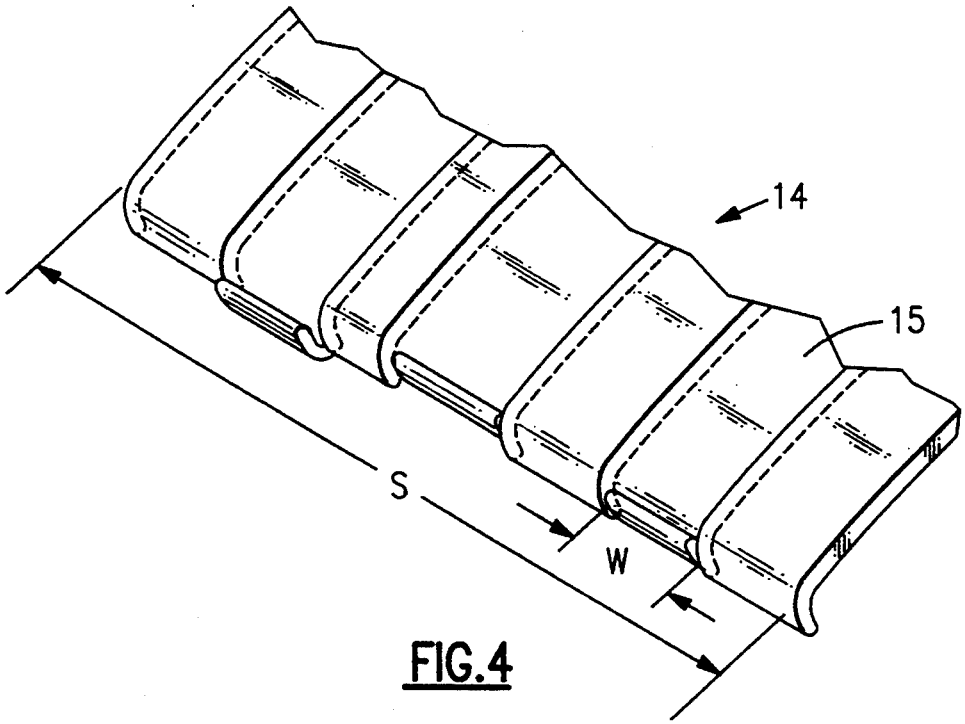
FIG. 4 is a pictorial view of the nose of the vortex wall of the present invention.

FIG. 4 shows a portion of the nose of vortex wall 14. It is the nose of wall 14 that is closest to the impeller in a fan installation. Over the span S of wall 14, it is divided into at least two segments, typified by segment 15. The nose of segment 15, as shown in FIG. 5, has a J-shaped cross section and J-tail 16. The segments are configured to form wall 14 so that the tails of the Js of adjacent segments point in opposite directions. The spanwise width of segment 15 is W.

Figure 6:
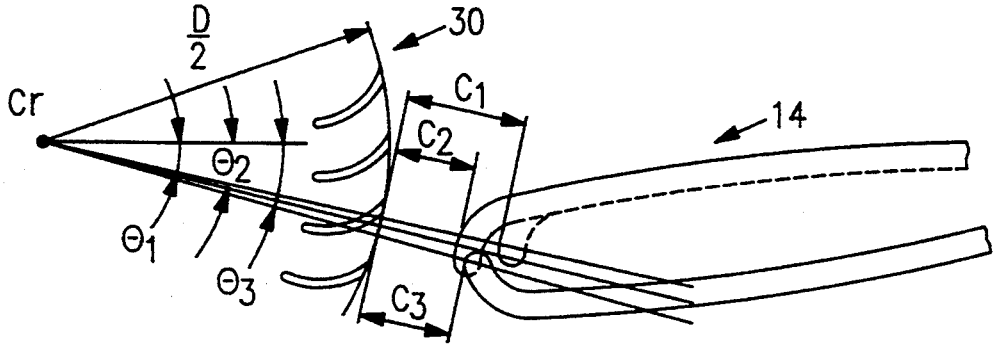
FIG. 6 is a another cross sectioned view of the nose of the vortex wall of the present invention in relationship to an impeller.

FIG. 6 shows an elevation view of vortex wall 14 together with its associated impeller 30. Impeller 30 rotates about center of rotation $C_R$ and has maximum swept diameter D. The distance between a segment and impeller 30 at its maximum swept diameter is clearance c. $c_1$, $c_2$ and $c_3$ are the clearances for the three segments visible in FIG. 6. Each segment has a discrete vortex wall setting angle $\theta$. The vortex wall setting angle is the angle between an arbitrary radial line from center of rotation $C_R$ and a radial line from center of rotation $C_R$ and the point on the segment nose where clearance c for that segment is least. $\theta_1$, $\theta_2$ and $\theta_3$ are the setting angles for the three segments visible in FIG. 6.

For best noise reduction performance, the spanwise width of the segments in a particular vortex wall should vary, within limits, randomly. The optimum spanwise width and number of segments in a wall invention is a function of several considerations including the overall length of the impeller with which the vortex wall will be used, the number of modules in that impeller and the configuration of the blades in the impeller. In the atypical case of a very short impeller, where the ratio of the impeller length to impeller diameter is less than one, then the spanwise width of the segments may be on the order of 0.4 times the span and a vortex wall having just two segments may provide the best noise reduction. In the more general case, where the ratio of impeller length to impeller diameter is greater than three, the spanwise width of the segments may be on the order of 0.2 times the span. There is a lower limit on the minimum width of an individual segment and the number of segments in a given wall. If the segments are too narrow, then the ability of the wall to reduce noise may be impaired. We believe that optimum noise reduction performance is achieved when no segment has a width that is less than 0.01 times the overall span of the wall and no segment has a width that is more than 0.5 times that overall span, or $0.01\ S<W<0.5\ S$. If the impeller is separated into modules, the number of segments in the vortex wall should be about 25 to 50 percent more than the number of modules. Further, the placement of the segments should be so that a single segment bridges across two adjacent modules.

The air moving performance of a transverse fan improves as the clearance between the impeller and the nose of the vortex wall decreases. In general, however, the noise produced by the fan also increases as the vortex wall-to-impeller clearance decreases. A good compromise between is to maintain nose-to-impeller clearance within the range of 0.04 to 0.12 times the swept diameter of impeller. To promote flow and pressure conditions in the fan that will minimize blade rate noise, we believe that the nose-to impeller clearance of the segments in the vortex wall should vary among the segments randomly within that range of $0.04\ D<c<0.12\ D$.

Varying setting angles among the segments has beneficial effects on noise reduction but excessively wide variations could result in degradation of overall fan performance. The setting angles should vary randomly among the segments within the bounds that no segment has a setting angle that is greater than 30 degrees different from the setting angle of any other segment or, $\Delta\theta_{max}=30°$.

As a an example of a suitable configuration for the vortex wall and impeller configuration for a fan of a typical size, we believe that for an impeller of approximately 40 cm in length and having seven modules, the overall span of the associated vortex wall would also be approximately 40 cm long, within that span the wall should be divided into 11 or 12 segments, the setting angles of the segments should vary randomly with no segment having a setting angle that is greater than ten degrees different from the setting angle of any other segment, and the ratio of the clearance to the maximum swept diameter of the impeller should vary randomly between 0.06 band 0.08.

We claim:

1. A vortex wall (14) and impeller (30) assembly for a transverse fan (10), said impeller having a maximum swept diameter (D) and said wall having a span (S), comprising at least two segments (15), each of said segments having a nose having a J-shaped cross section with a J tail (16), a spanwise width (W), a nose-to-impeller clearance (c) and a setting angle ($\theta$);

and said segments being arranged to form said wall so that a J tail of a given segment extends in the opposite direction from the direction in which the J tail of an adjacent segment extends, said spanwise widths vary randomly among the segments within the bounds that no segment has a spanwise width that is less than 0.01 times nor more than 0.5 times said span, said nose-to-impeller clearances vary randomly among the segments within the bounds that no segment has a clearance that is less than 0.04 times nor more than 0.12 times said maximum swept diameter, and said setting angles vary randomly among the total number of segments within the bounds that no segment has a setting angle that is greater than 30 degrees different than the setting angle of any other segment.

2. The vortex wall and impeller assembly of claim 1 in which said impeller is divided into modules (32) and the number of segments in said vortex wall is 25 to 50 percent greater than the number of modules in said impeller.

3. The vortex wall and impeller assembly of claim 1 in which said setting angles vary randomly among the total number of segments within the bounds that no segment has a setting angle that is greater than five degrees different than the setting angle of any other segment.

4. The vortex wall and impeller assembly of claim 1 in which said nose-to-impeller clearances vary randomly among the segments within the bounds that no segment has a clearance that is less than 0.06 times nor more than 0.08 times said maximum swept diameter.

* * * * *

UNITED STATES PATENT AND TRADEMARK OFFICE

CERTIFICATE OF CORRECTION

PATENT NO. : 5,449,271

DATED : September 12, 1995

INVENTOR(S) : Peter R. Bushnell et al

It is certified that error appears in the above-indentified patent and that said Letters Patent is hereby corrected as shown below:

On the title page, item [54] Title of Invention:

Change "Transverse Fan With Randomly Varying I-Shaped Tongue"

to read -- Transverse Fan With Randomly Varying J-Shaped Tongue --.

Signed and Sealed this

Seventh Day of November, 1995

*Attest:*

*Attesting Officer*

BRUCE LEHMAN

*Commissioner of Patents and Trademarks*